US009583233B2

(12) United States Patent
Guery et al.

(10) Patent No.: US 9,583,233 B2
(45) Date of Patent: Feb. 28, 2017

(54) ELECTRIC POWER TRANSMISSION CABLE PARTICULARLY FOR AN OVERHEAD LINE

(71) Applicant: NEXANS, Paris (FR)

(72) Inventors: Daniel Guery, Dour (BE); Michel Martin, Thuin (BE)

(73) Assignee: NEXANS, Paris (FR)

( * ) Notice: Subject to any disclaimer, the term of this patent is extended or adjusted under 35 U.S.C. 154(b) by 41 days.

(21) Appl. No.: 14/381,341

(22) PCT Filed: Feb. 28, 2013

(86) PCT No.: PCT/EP2013/054011

§ 371 (c)(1),
(2) Date: Aug. 27, 2014

(87) PCT Pub. No.: WO2013/135489

PCT Pub. Date: Sep. 19, 2013

(65) Prior Publication Data

US 2015/0027773 A1 Jan. 29, 2015

(30) Foreign Application Priority Data

Mar. 12, 2012 (FR) ..... 12 52180
Jul. 16, 2012 (EP) ..... 12176539

(51) Int. Cl.
*H01B 9/00* (2006.01)
*H01B 7/00* (2006.01)
*H01B 5/10* (2006.01)

(52) U.S. Cl.
CPC ..... *H01B 7/0009* (2013.01); *H01B 5/105* (2013.01); *H01B 9/008* (2013.01)

(58) Field of Classification Search
CPC ..... H01B 7/226; H01B 9/025
(Continued)

(56) References Cited

U.S. PATENT DOCUMENTS 7,402,753 B2 * 7/2008 Varkey ..... H01B 7/046 174/102 R
7,683,262 B2 * 3/2010 Guery ..... H01B 3/427 174/102 R (Continued)

FOREIGN PATENT DOCUMENTS

DE 1167932 4/1964
EP 1821318 4/2008

OTHER PUBLICATIONS

International Search Report dated 2013.

*Primary Examiner* — Chau N Nguyen
(74) *Attorney, Agent, or Firm* — Sofer & Haroun, LLP

(57) ABSTRACT

The invention concerns an electric power transmission cable, particularly for an overhead power line, comprising at least one central composite ring (1) formed of fibers impregnated by a matrix, of which the specific breaking strength is greater than 0.4 MPa·m$^3$/kg and at least one layer of conductive wires (3) nested within one another, made of aluminum or an aluminum alloy and windings around said ring (1), said cable having an outer diameter at ambient temperature called the initial diameter ($D_i$) and the ratio between the thermal expansion coefficient of the conductive wires (3) and that of the central ring (1) is greater than three. According to the invention, said conductive wires (3) nested within one another are of a geometry such that the increase in the outer diameter of one length of said cable shorter than 45 m, during an increase of temperature lasting two to four minutes, from ambient temperature to a temperature between 150 and 240° C., is less than or equal to 10% of the initial diameter (Di), said cable being subject to a mechanical tension between 10% and 30% of the nominal breaking strength of the cable. The invention also concerns a conductive wire geometry enabling such a level of expansion of the diameter.

6 Claims, 2 Drawing Sheets

(58) Field of Classification Search
USPC ..... 174/106 R
See application file for complete search history.

(56) References Cited

U.S. PATENT DOCUMENTS

| | | | | |
|---|---|---|---|---|
| 8,969,728 | B2 * | 3/2015 | Dorffer | 174/102 R |
| 2007/0193767 | A1 | 8/2007 | Guery et al. | |
| 2010/0059249 | A1 * | 3/2010 | Powers | H01B 5/104<br>174/128.1 |

* cited by examiner

ELECTRIC POWER TRANSMISSION CABLE PARTICULARLY FOR AN OVERHEAD LINE

RELATED APPLICATIONS

This application is a National Phase Application of PCT/EP2013/054011, filed on Feb. 28, 2013, which in turn claims the benefit of priority from French Patent Application No. 12 52180 filed on Mar. 12, 2012, and European Patent Application No. 121 76 539.0 filed on Jul. 16, 2012, the entirety of which are incorporated herein by reference.

BACKGROUND

Field of the Invention

The invention relates to an electric power transmission cable in particular for an overhead line.

It relates more specifically to an electric power transmission cable, in particular for an overhead electric power line, comprising at least one central composite core consisting of fibers impregnated by a matrix and the specific strength of which is greater than 0.4 MPa·m$^3$/kg and at least one layer of mutually interlocking conductive wires, made of aluminum or of an aluminum alloy and wound around this core.

Description of the Related Art

Such a cable is described in patent document EP 1 816 654.

This electric power transmission cable, in particular for an overhead electric power line, comprises a central composite core consisting of fibers impregnated by an epoxy resin matrix and two layers of conductive wires of Z- and S-shaped cross section, made of aluminum or of aluminum alloy, wound around the core. Optionally, the core may be covered with a layer of insulating material.

Such conductive wires are shaped wires according to the standard IEC 62219.

Such a cable may comprise a single central core, as represented, or three central cores.

It may also comprise one or more layers of conductive wires 3.

The operating temperature of such a cable may reach 200° C. or more. It therefore turns out, since all of the components of the cable are blocked at the ends by anchorages, that, during an increase in the temperature of the conductive wires, from ambient temperature to the operating temperature of the cable, the layers of conductive wire have a tendency to swell as a result of the difference in expansion coefficient of the core and of the conductive wires, and the conductive wires have a tendency to come out of their layer which may lead to a dislodgement of the wires out of their layer. It is even possible to observe the formation of a squirrel cage type positioning of the conductive wires which has a tendency to be reduced when the thermal stress has stopped.

It is to be feared that after a certain number of thermal cycles, one or more conductive wires do not return to their correct place within their layer and thus give rise to an increase in the corona effect and also an increase in noise nuisance.

OBJECTS AND SUMMARY

In order to solve this problem, the invention proposes an electric power transmission cable, in particular for an overhead electric power line, comprising at least one central composite core consisting of fibers impregnated by a matrix and the specific strength of which is greater than 0.4 MPa·m$^3$/kg and at least one layer of mutually interlocking conductive wires, made of aluminum or of an aluminum alloy and wound around this core, said cable having an external diameter at ambient temperature that is referred to as the initial diameter and the ratio between the thermal expansion coefficient of the conductive wires and that of the central core is greater than 3, characterized in that said mutually interlocking conductive wires (3) have a geometry such that the increase in the external diameter of a length of this cable of less than 45 m, during an increase in the temperature for two to four minutes, from ambient temperature to a temperature between 150° C. and 240° C., is less than or equal to 10% of its initial diameter, said cable being subjected to a mechanical tension of between 10% and 30% of the nominal tensile strength of the cable.

This cable comprises at least one layer of mutually interlocking conductive wires. More specifically, it may comprise one or more layers of mutually interlocking conductive wires, combined or not with at least one layer of conductive wires of round or trapezoidal cross section.

This cable comprises at least one central composite core consisting of fibers, for example glass, carbon, alumina or ceramic fibers, impregnated by a matrix which may be made of polymer, for example made of epoxy resin, or made of metal, for example made of aluminum, steel, titanium or tungsten.

The specific strength is the tensile strength normalized with respect to the density of the material or materials.

According to one preferred embodiment, the external diameter of the cable, after a subsequent reduction of its temperature to ambient temperature, is substantially equal to its initial diameter.

Preferably, the temperature is varied by applying or cutting an intensity of the current.

The cable for which each said mutually interlocking conductive wire has a side referred to as an upper side and a side referred to as a lower side that are positioned over a circular geometric cylinder having as longitudinal axis the longitudinal axis of the cable and as radius $R_s$ and $R_i$, characterized in that the width of each said conductive wire at the intersection of a circular geometric cylinder of the same longitudinal axis and of radius ½ ($R_s$+$R_i$) is between 80% and 120% of the difference ($R_s$−$R_i$).

Owing to such a geometry, the radial displacement of the conductive wires is limited or even prevented, while having a low level of noise nuisance in the event of high winds.

It is also possible to produce a cable having a drag coefficient that is advantageous in the field of the working wind speeds, for example and nonexhaustively: the design speeds $V_{1QB}$ and $V_{2QB}$ and provided by Belgian regulations, and to retain this property despite the multiple and severe thermal stresses that the cable will undergo during its service life. In order to obtain this result, it is necessary for the outer layer to consist of mutually interlocking shaped wires, for the width of each of its wires to correspond to the criteria cited above and for the depth of the grooves of each wire to correspond to the criteria of the patent EP 0 379 853.

Preferably, said width of each said conductive wire is substantially equal to the difference ($R_s$−$R_i$).

Said conductive wire has a Z-, S- or C-shaped cross section.

Advantageously, said fibers of the core are made of carbon and said matrix is made of epoxy resin.

Preferably, the conductive wires are based on an alloy of aluminum and zirconium.

The core may comprise a waterproof casing as described in patent application WO 2010/089500.

A dielectric layer may optionally be positioned between this coating and the composite core.

BRIEF DESCRIPTION OF THE DRAWINGS

The invention is described below in greater detail with the aid of figures that illustrate preferred embodiments of the invention only.

DETAILED DESCRIPTION

Figure 1:
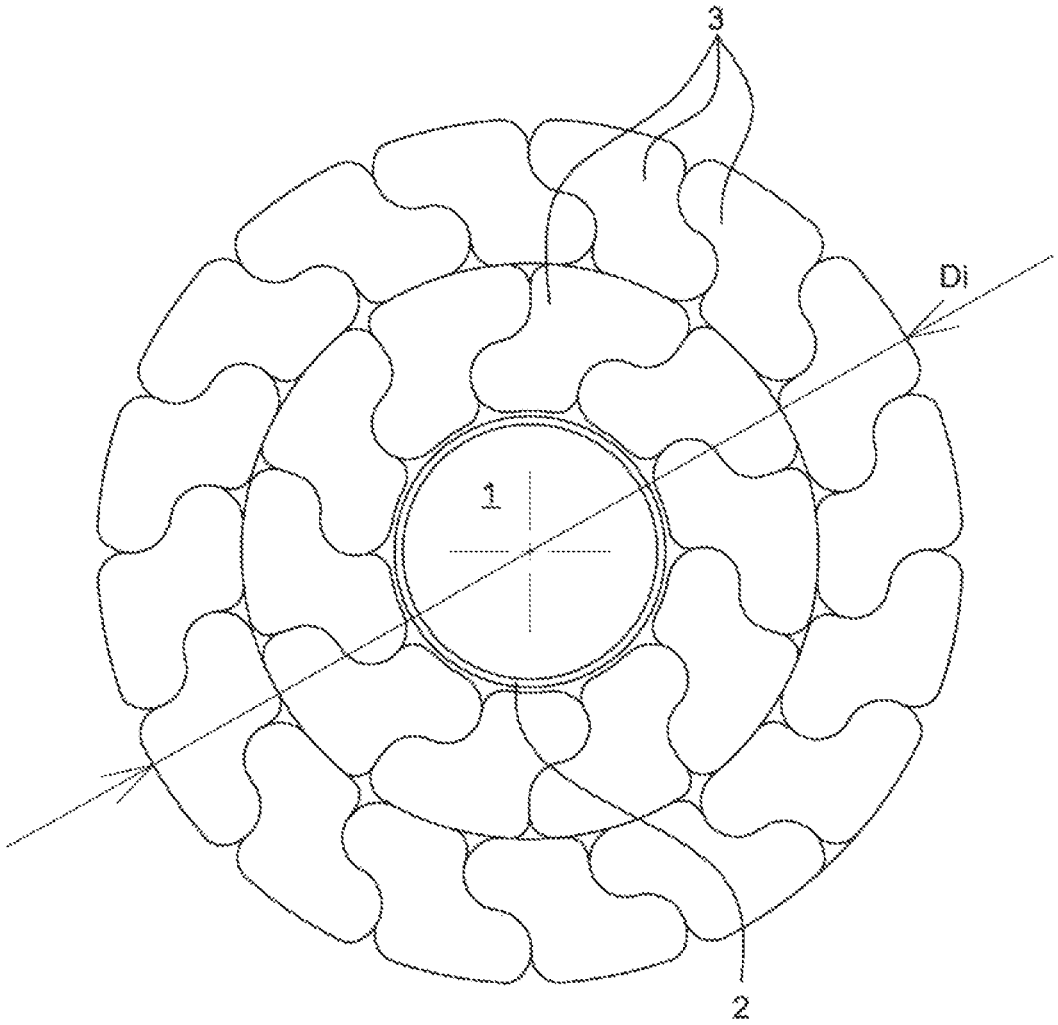
FIG. 1 is a cross-sectional view of a cable according to the invention.

As represented in FIG. 1, the invention relates to an electric power transmission cable, in particular for an overhead electric power line, comprising at least one central composite core 1 consisting of fibers impregnated by a matrix and the specific strength of which is greater than 0.4 $MPa \cdot m^3/kg$ and at least one layer of mutually interlocking conductive wires 3, made of aluminum or of an aluminum alloy and wound around this core 1. The core 1 may comprise a waterproof coating 2.

Preferably, the conductive wires are based on an alloy of aluminum and zirconium.

This cable has an external diameter at ambient temperature referred to as the initial diameter and the ratio between the thermal expansion coefficient of the conductive wires and that of the central core is greater than three.

According to the invention, the mutually interlocking conductive wires (3) have a geometry such that the increase in the external diameter of a length of this cable of less than 45 m, during an increase in the temperature for two to four minutes, from ambient temperature to a temperature between 150° C. and 240° C., is less than or equal to 10% of its initial diameter, said cable being subjected to a mechanical tension of between 10% and 30% of the nominal tensile strength of the cable.

Furthermore, preferably, its external diameter, after a subsequent reduction of the temperature to ambient temperature, is substantially equal to its initial diameter.

Figure 2:
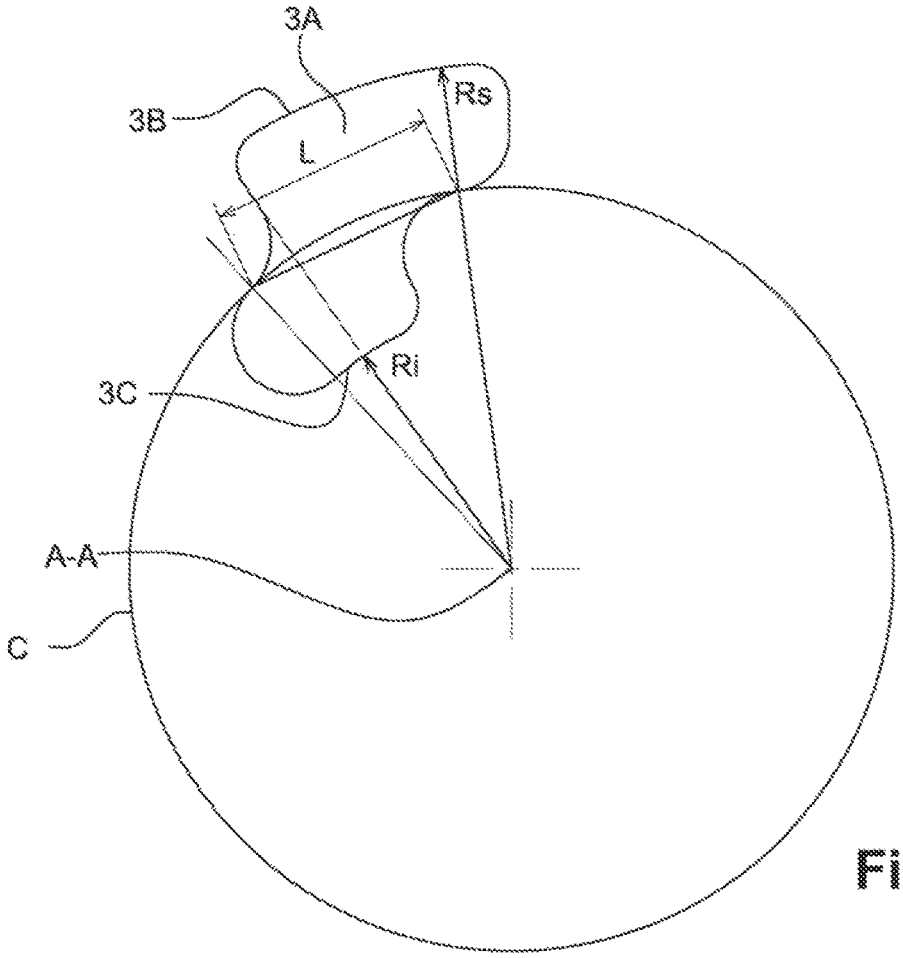
FIGS. 2 to 4 are transverse cross-sectional views of a conductive wire according to several embodiments of the invention.
Figure 3:
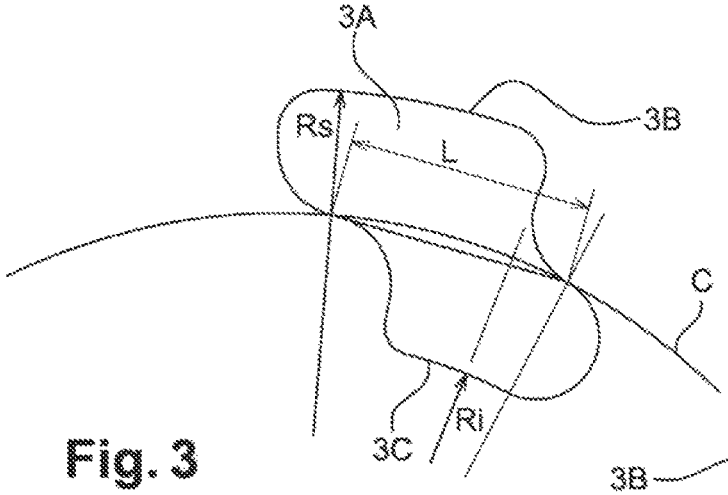
Figure 4:
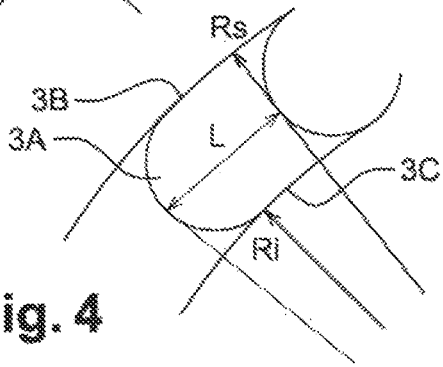

FIGS. 2 to 4 are transverse cross-sectional views of examples of conductive wires that make it possible to ensure such a limited degree of expansion of the diameter.

FIG. 2 represents a Z-shaped conductive wire.

This conductive wire 3A has a side referred to as an upper side 3B and a side referred to as a lower side 3C that are each positioned over a circular geometric cylinder having as longitudinal axis the longitudinal axis A-A of the cable and as radius $R_s$ and $R_i$, and is such that the width L of this conductive wire at the intersection of a circular geometric cylinder C of the same longitudinal axis A-A and of radius ½ $(R_s+R_i)$ is between 80% and 120% of the difference $(R_s-R_i)$.

Preferably, this width L of each conductive wire is substantially equal to the difference $(R_s-R_i)$.

According to this first example, the cable has a Z-shaped cross section, but it may be generally mutually interlocking, for example having an S-shape or C-shape.

FIG. 3 represents an S-shaped mutually interlocking conductive wire and FIG. 4 represents a C-shaped mutually interlocking conductive wire.

These conductive wires 3A comprise a side referred to as the upper side 3B and a side referred to the lower side 3C that are each positioned over a circular geometric cylinder having as longitudinal axis the longitudinal axis AA of the cable and as radius $R_s$ and $R_i$, and are such that the width L of these conductive wires at the intersection of a circular geometric cylinder C of the same longitudinal axis A-A and of radius ½ $(R_s+R_i)$ is between 80% and 120% of the difference $(R_s-R_i)$.

Preferably, this width L of these conductive wires is substantially equal to the difference $(R_s-R_i)$.

The preceding features are verified by the following test carried out, for example, on a cable comprising two layers of mutually interlocking conductive shaped wires.

A length of cable of less than 45 m, and preferably between 10 and 45 m, is used and is provided at its ends with a conventional epoxy resin sleeve in order to ensure that the layers keep substantially the same position relative to that obtained on leaving the manufacturing line and more particularly without these layers unwinding. The conductive wires of the layers are splayed in the epoxy resin sleeves and the layers are reformed on leaving the sleeves in order to enable connection to an alternating current electric power unit via conventional connectors. The epoxy resin sleeves are introduced into conical sockets made of aluminum connected to tensioning devices in order to maintain a mechanical tension. On one side of the cable, a load cell is placed between the cable and the anchoring device and, on the other side of the cable, the latter is directly connected to the other anchoring device. The anchoring devices are solid enough to minimize deflections of the ends of the device when a mechanical tension is applied. For the test, the mechanical tension applied at ambient temperature has a value of between 10% and 30% of the nominal tensile strength of the cable. The temperature is measured at three locations along the length of the cable under test, preferably at ¼, ½ and ¾ of the distance between the ends, using thermocouples. At each location, the thermocouples are placed at three different radial positions on the cable, namely on the outer layer of conductive wires, on the inner layer of conductive wires and in contact with the central core.

The external diameter of the cable is measured at the middle of the length of cable under test firstly in the initial, state at ambient temperature.

The intensity of the current then applied to the cable is such that the layers of conductive wires reach a temperature between 150° C. and 240° C. in a time of between two and four minutes. The reference temperature taken into account is the highest one given by the thermocouples.

As soon as this current is cut, the external diameter is measured at the same location. Then this diameter is again measured at the same location, when the cable has returned to ambient temperature.

According to the invention, the increase in the external diameter just after cutting the current is less than or equal to 10% of its initial external diameter and the external diameter after thermal stress and return to ambient temperature is substantially equal to its initial diameter.

After the test, five 30 cm samples of shaped wires from the outer layer can be removed, carefully so as not to deform them in the central part of the cable. The radii of curvature of the upper side of the wires are measured. The outer layer produced from these elements has a smooth outer surface apart from small helical grooves provided by these radii of curvature. These radii of curvature must be substantially equal to those of the wire on leaving the production line. The measurement of these radii is carried out using the "Shaped Die/Wire&Rod System combination; Version A: Electra Optical Frame CU10 Die Wire & Rod Supervisor" device from the company Conoptica.

This test method is carried out with a cable such as specified below at a temperature of 240° C.

This electric power transmission cable, in particular for an overhead electric power line, is as represented in FIG. 1 and comprises a central composite core consisting of continuous carbon fibers impregnated by an epoxy resin matrix, and two layers of mutually interlocking conductive shaped wires, including one outer layer with Z-shaped wires and one inner layer with S-shaped wires as specified above, made of an alloy of aluminum and zirconium, that are helically wound around this core so as to mutually interlock. The conductive wires are wires such as described above with reference to FIGS. 2 and 3.

This cable is defined by the following features:

| | Conductive wires | Central core |
|---|---|---|
| Nominal cross section | 341 $mm^2$ | 38.5 $mm^2$ |
| Weight | 947 kg/km | 63 kg/km |
| Elastic modulus | 57 $kN/mm^2$ | 170 $kN/mm^2$ |
| Thermal expansion coefficient | $23 \times 10^{-6}$/° C. | $0.2 \times 10^{-6}$/° C. |

The results after the test are:

| External diameter | Measurements taken (mm) | Mean (mm) |
|---|---|---|
| Measurements before test | 23.4-23.3-23.5 | 23.4 |
| Measurements after cutting current | 24.7-24.8-24.9 | 24.8 |
| Measurement after return to the initial temperature | 23.3-23.4-23.5 | 23.4 |

Furthermore, the measurements of the radii of curvature remain equal:

| | Diameter and tolerances of the radii of curvature (mm) |
|---|---|
| Before test | 0.7 ± 0.1 |
| After test | 0.7 ± 0.1 |

which demonstrates that the depth of the grooves of each wire correspond to the criteria of patent EP 0 379 853 and that a good wind resistance is retained despite the heat treatment.

The invention claimed is:

1. Electric power transmission cable comprising:

at least one central composite core having fibers impregnated by a matrix and the specific strength of which is greater than 0.4 $MPa \cdot m^3/kg$ and at least one layer of mutually interlocking conductive wires, made of aluminum or of an aluminum alloy and wound around this core, said cable having an external diameter at ambient temperature that is referred to as the initial diameter (Di) and the ratio between the thermal expansion coefficient of the conductive wires and that of the central core is greater than three, cable for which each said mutually interlocking conductive wire has a side referred to as an upper side and a side referred to as a lower side that are positioned over a circular geometric cylinder having as longitudinal axis the longitudinal axis (A-A) of the cable and as radius $R_s$ and $R_i$, wherein the width (L) of each said conductive wire at the intersection of a circular geometric cylinder of the same longitudinal axis (A-A) and of radius ½ $(R_s+R_i)$ is between 80% and 120% of the difference $(R_s-R_i)$.

2. Cable according to claim 1, wherein said width (L) of each said conductive wire is substantially equal to the difference $(R_s-R_i)$.

3. Cable according to claim 1, wherein said conductive wires have a Z-, S- or C-shaped cross section.

4. Cable according to claim 1, wherein said fibers of the core are made of carbon and said matrix is made of epoxy resin.

5. Cable according to claim 1, wherein said conductive wires are based on an alloy of aluminum and zirconium.

6. Cable according to claim 1, wherein said core comprises a waterproof coating.

* * * * *